US006715385B2

(12) United States Patent
Wu

(10) Patent No.: US 6,715,385 B2
(45) Date of Patent: Apr. 6, 2004

(54) COMBINATION TOOL FOR ASSEMBLING AND DISMANTLING A LOCK NUT OF A BEARING OF A WHEEL AXLE OF A WHEELED VEHICLE

(76) Inventor: Yu-Yen Wang Wu, P.O. Box 55-124, Taichung (TW)

( * ) Notice: Subject to any disclaimer, the term of this patent is extended or adjusted under 35 U.S.C. 154(b) by 61 days.

(21) Appl. No.: 10/109,704

(22) Filed: Apr. 1, 2002

(65) Prior Publication Data

US 2003/0041701 A1 Mar. 6, 2003

(30) Foreign Application Priority Data

Apr. 9, 2001 (TW) ..... 90205587 U

(51) Int. Cl.[7] ..... B25B 13/48
(52) U.S. Cl. ..... 81/176.15; 81/163
(58) Field of Search ..... 81/13, 90.3, 90.9, 81/126, 128, 129, 163–165, 176.15, 176.2, 176.3, 179, 186, 447; 269/249

(56) References Cited

U.S. PATENT DOCUMENTS

| | | | | | |
|---|---|---|---|---|---|
| 210,684 | A | * | 12/1878 | Goodrich | 81/118 |
| 533,844 | A | * | 2/1895 | Dunham | 81/128 |
| 545,944 | A | * | 9/1895 | Champane | 81/118 |
| 828,440 | A | * | 8/1906 | Sullivan | 81/63.2 |
| 928,764 | A | * | 7/1909 | Jenrich | 81/63.2 |
| 2,190,585 | A | * | 2/1940 | Rhinevault | 269/249 |
| 2,562,131 | A | * | 7/1951 | Scovill | 81/163 |
| 2,743,641 | A | * | 5/1956 | Stricklett et | 81/163 |
| 2,801,562 | A | * | 8/1957 | Stricklett et al. | 81/163 |
| 4,864,901 | A | * | 9/1989 | le Duc | 81/163 |
| 5,135,209 | A | * | 8/1992 | Penny | 269/249 |
| 5,860,197 | A | * | 1/1999 | Fox | 24/522 |

* cited by examiner

*Primary Examiner*—Lee D. Wilson
*Assistant Examiner*—David B. Thomas

(57) ABSTRACT

A combination tool for assembling and dismantling a lock nut of a bearing of a wheel axle of a wheeled vehicle includes a middle column, a first clamp block, a second clamp block, a regulating threaded rod, and a support rod. The first clamp block and the second clamp block are located at two sides of the middle column, and each of the first clamp block and the second clamp block has one end provided with a clamp pawl. The regulating threaded rod is extended through the middle column, for adjusting the distance between the first clamp block and the second clamp block. The support rod is extended through the second clamp block, the middle column and the first clamp block, to support and position the middle column, the first clamp block, and the second clamp block.

19 Claims, 11 Drawing Sheets

COMBINATION TOOL FOR ASSEMBLING AND DISMANTLING A LOCK NUT OF A BEARING OF A WHEEL AXLE OF A WHEELED VEHICLE

BACKGROUND OF THE INVENTION

1. Field of the Invention

The present invention relates to a combination tool for assembling and dismantling a lock nut of a bearing of a wheel axle of a wheeled vehicle such as an automobile or the like.

2. Description of the Related Art

Usually, the distal end of the wheel axle of an automobile is pivotally provided with a bearing, and a lock nut is screwed on the outside of the bearing for positioning the bearing. It is necessary to remove the lock nut previously for replacing the bearing when the bearing is worn out.

A first kind of a conventional lock nut includes a hexagonal nut or an octagonal nut. In general, the operator may use a hexagonal socket wrench for assembling and dismantling the hexagonal lock nut, and may use an octagonal socket wrench for assembling and dismantling the octagonal lock nut.

A second conventional lock nut of a bearing of a wheel axle of a wheeled vehicle in accordance with the prior art shown in FIG. 1 includes a disk-shaped lock nut which defines a screw hole 1, and two opposite insertion holes 2. Referring to FIG. 2, the operator may use an elongated tool which is provided with two insertion stubs 3 that may be respectively inserted into the insertion holes 2 of the disk-shaped lock nut, for assembling and dismantling the disk-shaped lock nut.

However, the operator has to additionally prepare hand tools of different specifications and types so as to assemble and dismantle lock nuts of different kinds and sizes, such as a hexagonal lock nut, an octagonal lock nut, a disk-shaped lock nut or the like, thereby greatly causing inconvenience to the operator when assembling and dismantling the lock nuts.

SUMMARY OF THE INVENTION

The primary objective of the present invention is to provide a combination tool for assembling and dismantling a lock nut of a bearing of a wheel axle of a wheeled vehicle, wherein the combination tool can be used to assemble and dismantle lock nuts of different kinds and sizes, without having to prepare tools of different specifications and types, thereby greatly facilitating the operator assembling and dismantling the lock nuts.

In accordance with the present invention, there is provided a combination tool for assembling and dismantling a lock nut of a bearing of a wheel axle of a wheeled vehicle, comprising a middle column, a first clamp block, a second clamp block, a regulating threaded rod, and a support rod, wherein:

the middle column has a first end having an end face having an axial center defining a polygonal recess;

the first clamp block and the second clamp block are located at two sides of the middle column, and a distance between the first clamp block and the middle column is equal to that between the second clamp block and the middle column, each of the first clamp block and the second clamp block has one end respectively provided with a clamp pawl;

the regulating threaded rod is radially extended through the middle column, so that the middle column is positioned at a middle section of the regulating threaded rod, the regulating threaded rod has a first end provided with a first threaded section and a second end provided with a second threaded section having a screw direction opposite to that of the first threaded section, the first threaded section and the second threaded section are respectively extended through the first clamp block and the second clamp block, so that a distance between the first clamp block and the second clamp block can be adjusted; and the support rod is in turn extended through the second clamp block, the middle column and the first clamp block, to support and position the middle column, the first clamp block, and the second clamp block.

Further benefits and advantages of the present invention will become apparent after a careful reading of the detailed description with appropriate reference to the accompanying drawings.

DETAILED DESCRIPTION OF THE INVENTION

Figure 3:
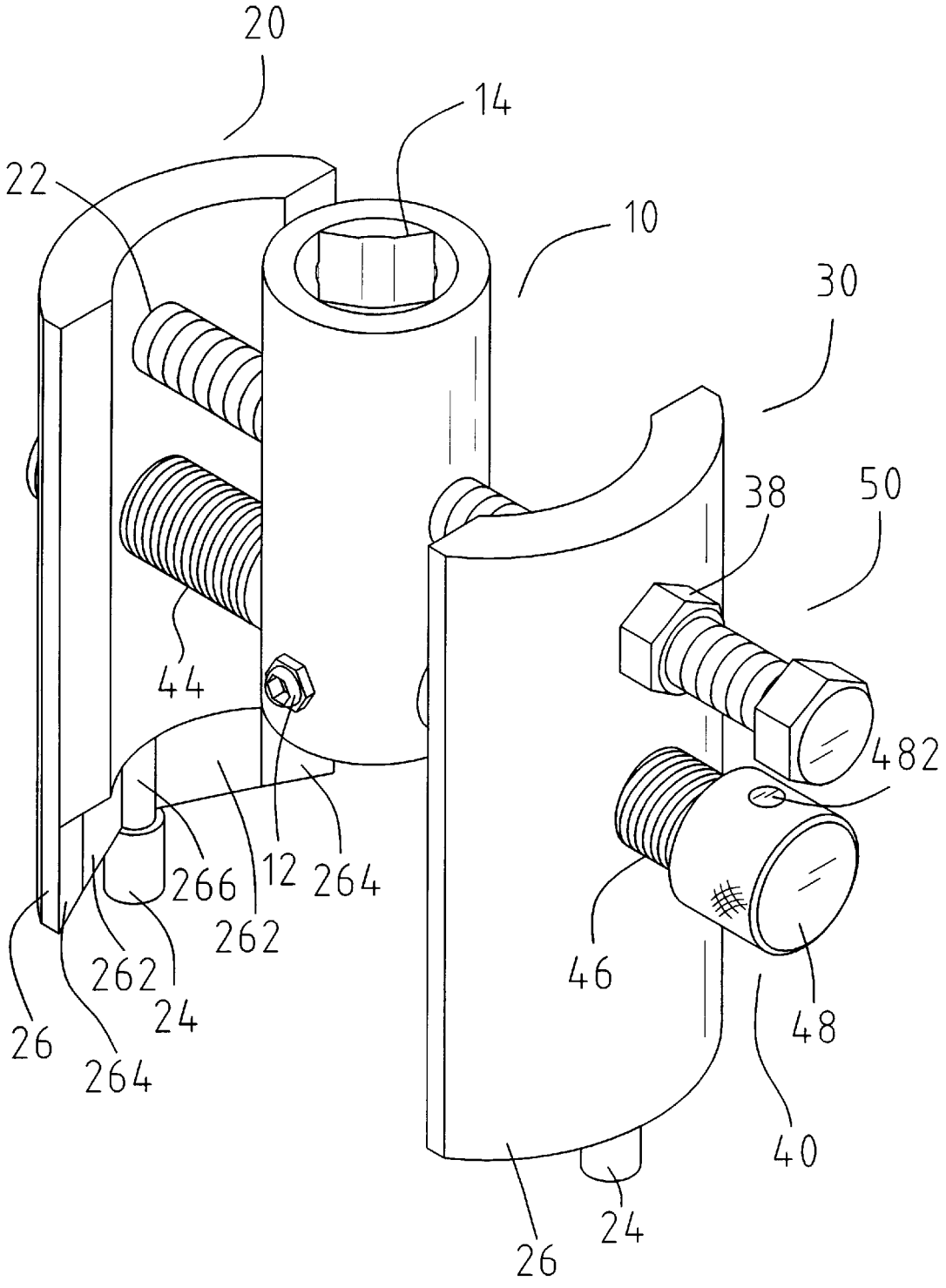
FIG. 3 is a perspective view of a combination tool for assembling and dismantling a lock nut of a bearing of a wheel axle of a wheeled vehicle in accordance with a first embodiment of the present invention.
Figure 4:
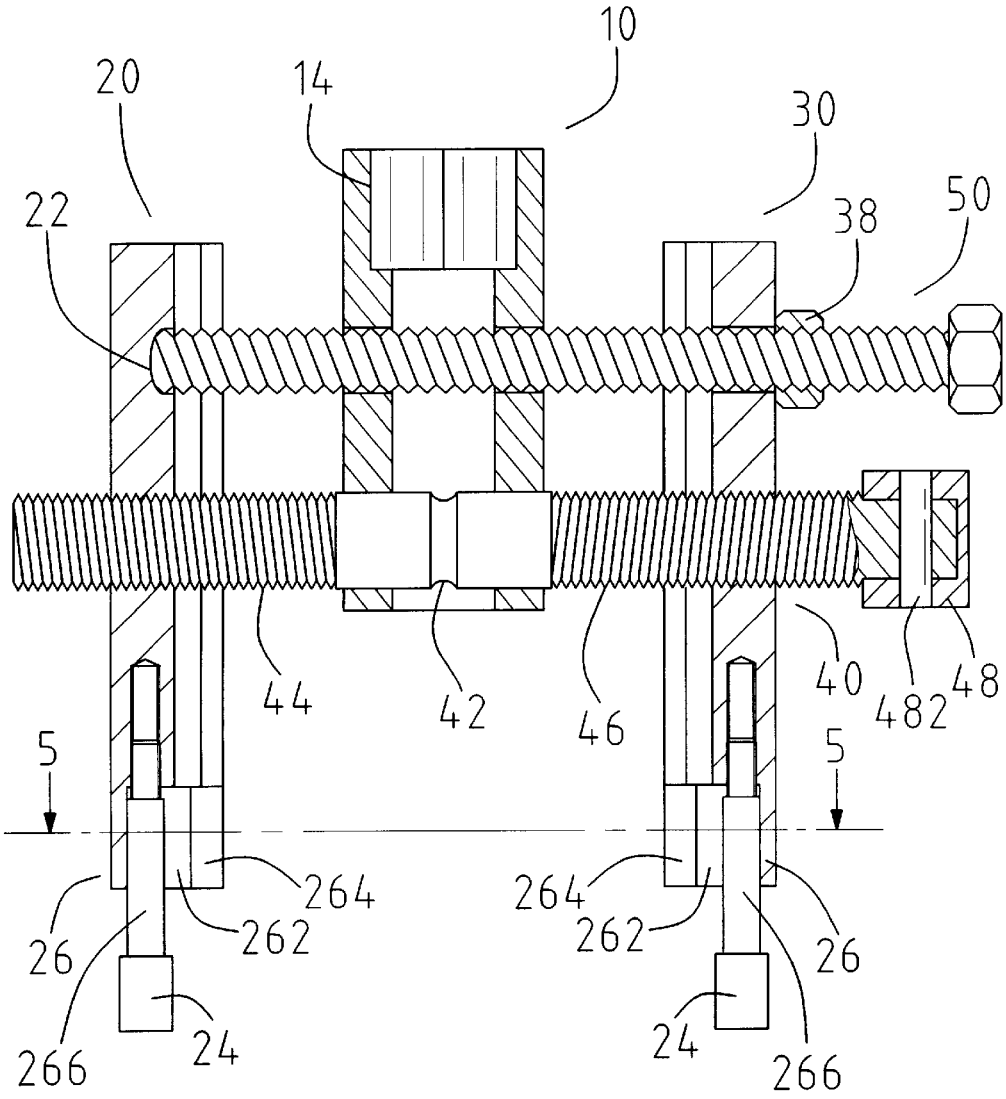
FIG. 4 is a front plan cross-sectional view of the combination tool for assembling and dismantling a lock nut of a bearing of a wheel axle of a wheeled vehicle as shown in FIG. 3.
Figure 5:
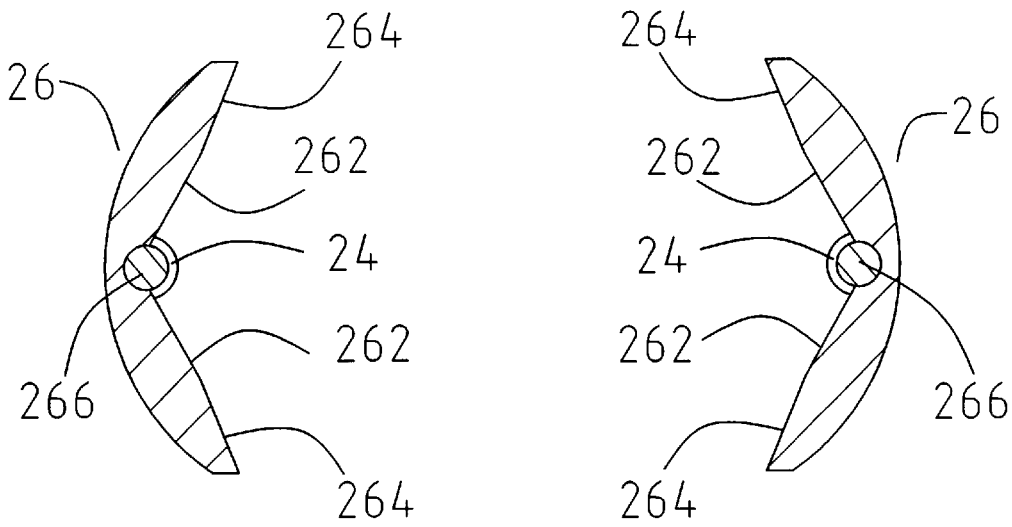
FIG. 5 is a cross-sectional view of the combination tool along the line 5—5 as shown in FIG. 4.

Referring to the drawings and initially to FIGS. 3–5, a combination tool for assembling and dismantling a lock nut of a bearing of a wheel axle of a wheeled vehicle in accordance with a first embodiment of the present invention comprises a middle column 10, a first clamp block 20, a second clamp block 30, a regulating threaded rod 40, and a support rod 50.

The middle column 10 has a first end having an end face having an axial center defining a polygonal recess 14.

The first clamp block 20 and the second clamp block 30 are located at the two sides of the middle column 10 respectively, and the distance between the first clamp block 20 and the middle column 10 is equal to that between the second clamp block 30 and the middle column 10. Namely, the middle column 10 is located at the middle position between the first clamp block 20 and the second clamp block 30.

The regulating threaded rod 40 is radially extended through the middle column 10, so that the middle column 10 is positioned at the middle section of the regulating threaded rod 40. The middle section of the regulating threaded rod 40 is formed with an annular insertion groove 42. A positioning bolt 12 is radially extended through a second end of the middle column 10 and has a distal end inserted into the insertion groove 42 of the regulating threaded rod 40, such that the middle column 10 is positioned at the middle section of the regulating threaded rod 40.

The regulating threaded rod 40 has a first end provided with a first threaded section 44 and a second end provided with a second threaded section 46 that has a screw direction opposite to that of the first threaded section 44. The first threaded section 44 and the second threaded section 46 are extended through the first clamp block 20 and the second clamp block 30 respectively. Thus, when the regulating threaded rod 40 is rotated, the first clamp block 20 and the second clamp block 30 are driven to move toward each other or to move outward relative to each other on the regulating threaded rod 40, such that the distance between the first clamp block 20 and the second clamp block 30 can be adjusted. An end cap 48 is secured on one end of the regulating threaded rod 40, and an insertion pin 482 is radially extended through the end cap 48 and the regulating threaded rod 40, thereby facilitating rotation of the regulating threaded rod 40.

The support rod 50 is in turn extended through a nut 38 that is secured on an outer wall of the second clamp block 30, the second clamp block 30, the middle column 10, and is pivotally inserted into the first clamp block 20, to support and position the middle column 10, the first clamp block 20, and the second clamp block 30. Preferably, the first clamp block 20 has an inner wall defining an insertion cavity 22, and the support rod 50 is in turn extended through the second clamp block 3 0 and the middle column 10, and has a distal end pivotally inserted into the insertion cavity 22 of the first clamp block 20, to support and position the middle column 10, the first clamp block 20, and the second clamp block 30, so that the first clamp block 20 and the second clamp block 30 cannot be rotated relative to each other.

Figure 9:
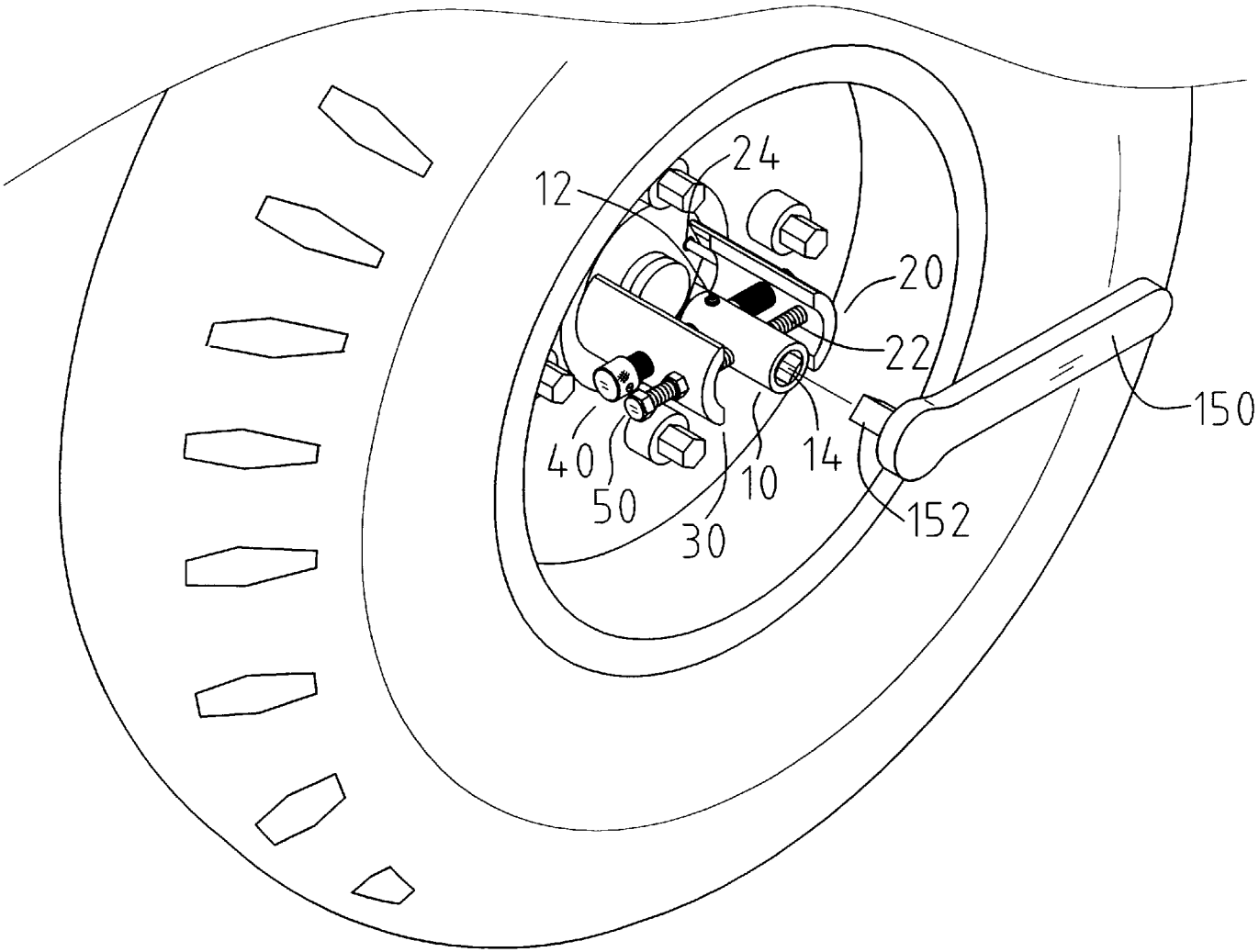
FIG. 9 is a schematic operational view of the combination tool for assembling and dismantling a lock nut of a bearing of a wheel axle of a wheeled vehicle as shown in FIG. 3 in use.

In addition, the first end of the middle column 10 adjacent to the support rod 50 is protruded outward from the region enclosed by the first clamp block 20 and the second clamp block 30. Thus, the driver head 152 (see FIG. 9) of a hand tool such as a ratchet wrench 150 (see FIG. 9) or the like may be inserted into the polygonal recess 14 of the middle column 10, to rotate the middle column 10, so as to drive the first clamp block 20 and the second clamp block 30 to rotate.

Referring to FIGS. 5–8 with reference to FIGS. 3 and 4, each of the first clamp block 20 and the second clamp block 30 has one end respectively provided with a clamp pawl 26. As shown in FIG. 5, the clamp pawl 26 has an inner edge having two opposite sides each formed with a first clamp face 262 and a second clamp face 264. The first clamp face 262 is adjacent to a central shaft 266 of the inner edge of the clamp pawl 26.

Figure 6:
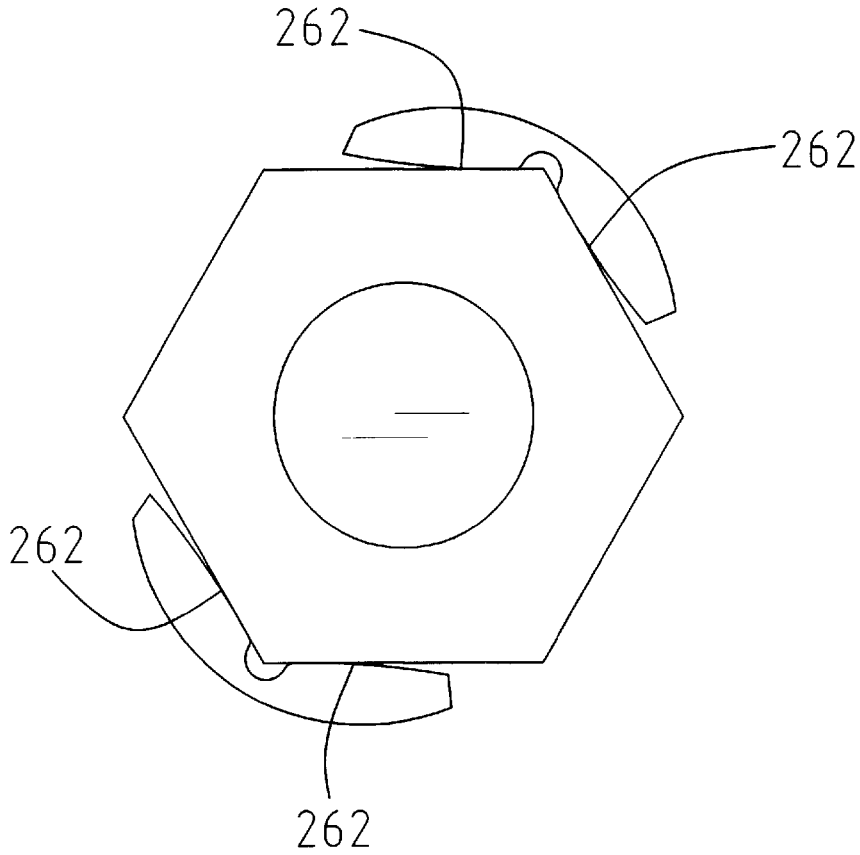
FIG. 6 is a schematic operational view of the combination tool for assembling and dismantling a lock nut of a bearing of a wheel axle of a wheeled vehicle as shown in FIG. 5 in use.

The first clamp faces 262 of the two opposite sides of the inner edge of the clamp pawl 26 are symmetrical with each other, and have an included angle equal to 120 degrees, for clamping the outer periphery of a hexagonal lock nut as shown in FIG. 6.

Figure 7:
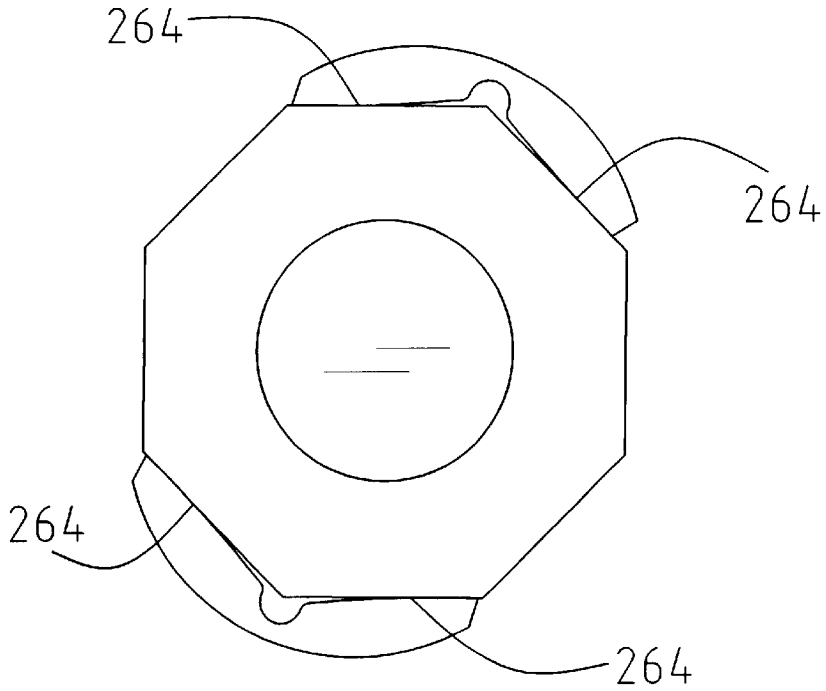
FIG. 7 is a schematic operational view of the combination tool for assembling and dismantling a lock nut of a bearing of a wheel axle of a wheeled vehicle as shown in FIG. 5 in use.

The second clamp faces 264 of the two sides of the inner edge of the clamp pawl 26 are symmetrical with each other, and have an included angle equal to 135 degrees, for clamping the outer periphery of a octagonal lock nut as shown in FIG. 7.

Figure 8:
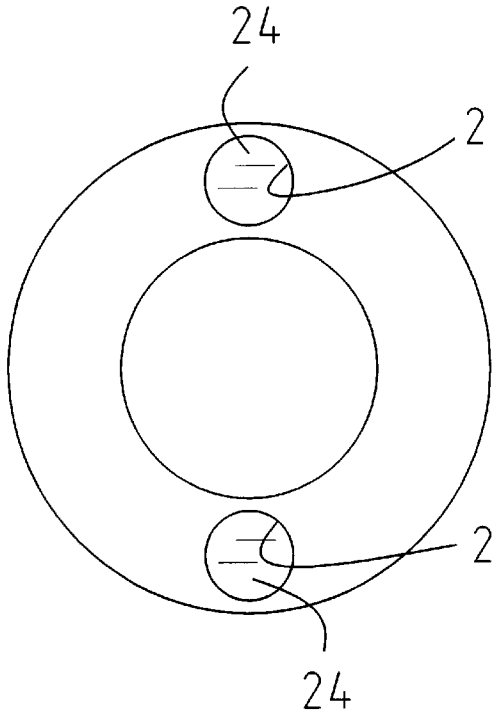
FIG. 8 is a schematic operational view of the combination tool for assembling and dismantling a lock nut of a bearing of a wheel axle of a wheeled vehicle as shown in FIG. 5 in use.

Each of the first clamp block 20 and the second clamp block 30 has a distal end having a central portion respectively screwed with a pin 24 and 34 that may be inserted into two opposite holes 2 of a disk-shaped lock nut (see FIG. 1), for assembling and dismantling the disk-shaped lock nut as shown in FIG. 8.

In operation, referring to FIGS. 3–9, when the regulating threaded rod 40 is rotated, the middle column 10, the first clamp block 20, and the second clamp block 30 are retained by the support rod 50, so that they are not rotated with the regulating threaded rod 40, thereby capable of changing the distance between the first clamp block 20 and the second clamp block 30. At this time, the support rod 50 may be rotated properly, so that the distal end of the support rod 50 is retained in the insertion cavity 22 without restricting displacement of the first clamp block 20 and the second clamp block 30. The distal end of the positioning bolt 12 is inserted into the insertion groove 42 of the regulating threaded rod 40, such that the middle column 10 is positioned at the middle section of the regulating threaded rod 40.

Referring to FIG. 6, the pins 24 and 34 are removed, and the first clamp faces 262 of the two sides of the inner edge of the clamp pawl 26 may urge and clamp the outer periphery of the hexagonal lock nut. Thus, the driver head 152 (see FIG. 9) of the ratchet wrench 150 (see FIG. 9) may be inserted into the polygonal recess 14 of the middle column 10, to rotate the middle column 10, so as to drive the first clamp block 20 and the second clamp block 30 to rotate, so that the hexagonal lock nut can be rotated, so as to assemble and dismantle the hexagonal lock nut.

Referring to FIG. 7, the pins 24 and 34 are removed, and the second clamp faces 264 of the two sides of the inner edge of the clamp pawl 26 may urge and clamp the outer periphery of the octagonal lock nut. Thus, the driver head 152 (see FIG. 9) of the ratchet wrench 150 (see FIG. 9) may be inserted into the polygonal recess 14 of the middle column 10, to rotate the middle column 10, so as to drive the first clamp block 20 and the second clamp block 30 to rotate, so that the octagonal lock nut can be rotated, so as to assemble and dismantle the octagonal lock nut.

Figure 1:
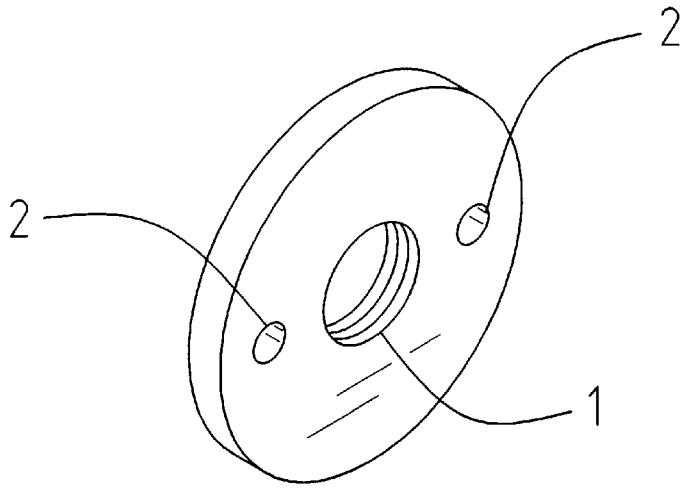
FIG. 1 PRIOR ART
FIG. 1 is a perspective view of a conventional disk-shaped lock nut of a bearing of a wheel axle of a wheeled vehicle in accordance with the prior art.
Figure 2:
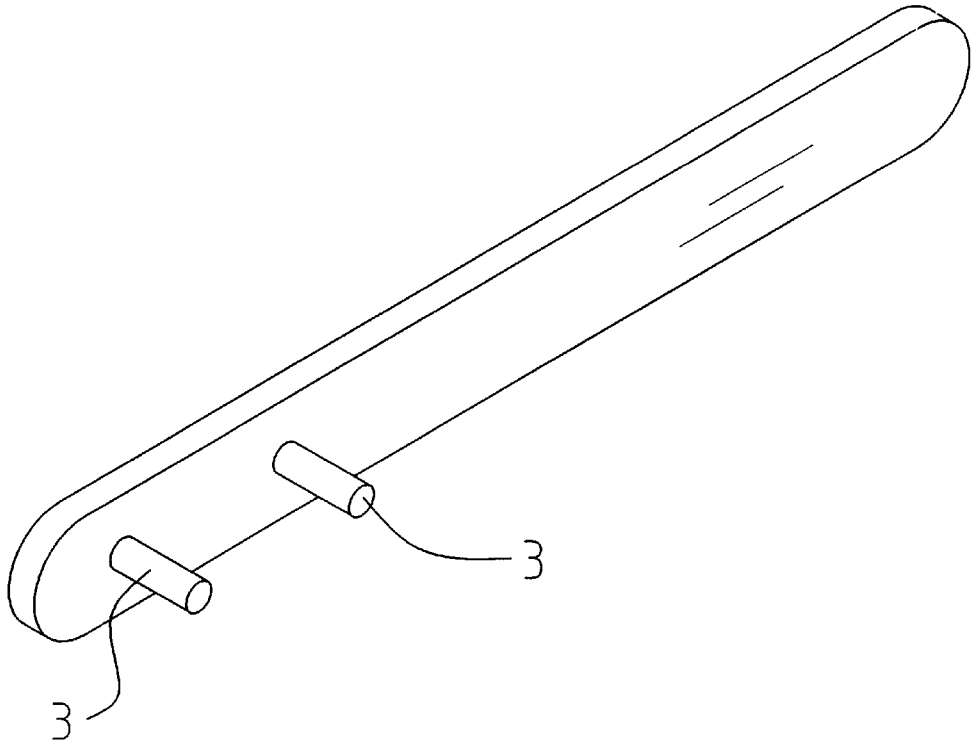
FIG. 2 PRIOR ART
FIG. 2 is a perspective view of a conventional tool for assembling and dismantling the conventional lock nut as shown in FIG. 1.

Referring to FIG. 8, the pins 24 and 34 are respectively screwed on the first clamp block 20 and the second clamp block 30, while the distal ends of the pins 24 and 34 are respectively inserted into the two opposite holes 2 of the disk-shaped lock nut (see FIG. 1). Thus, the driver head 152 (see FIG. 9) of the ratchet wrench 150 (see FIG. 9) may be inserted into the polygonal recess 14 of the middle column 10, to rotate the middle column 10, so as to drive the first clamp block 20 and the second clamp block 30 to rotate, so that the disk-shaped lock nut can be rotated, so as to assemble and dismantle the disk-shaped lock nut.

Accordingly, the combination tool for assembling and dismantling a lock nut of a bearing of a wheel axle of a wheeled vehicle in accordance with the present invention includes an adjustable construction that may be regulated properly according to the kind and the size of the lock nut to be operated, so as to assemble and dismantle the lock nut, so that the combination tool of the present invention can be used to assemble and dismantle lock nuts of different kinds and sizes, without having to prepare tools of different specifications and types, thereby greatly facilitating the operator assembling and dismantling the lock nuts.

Figure 10:
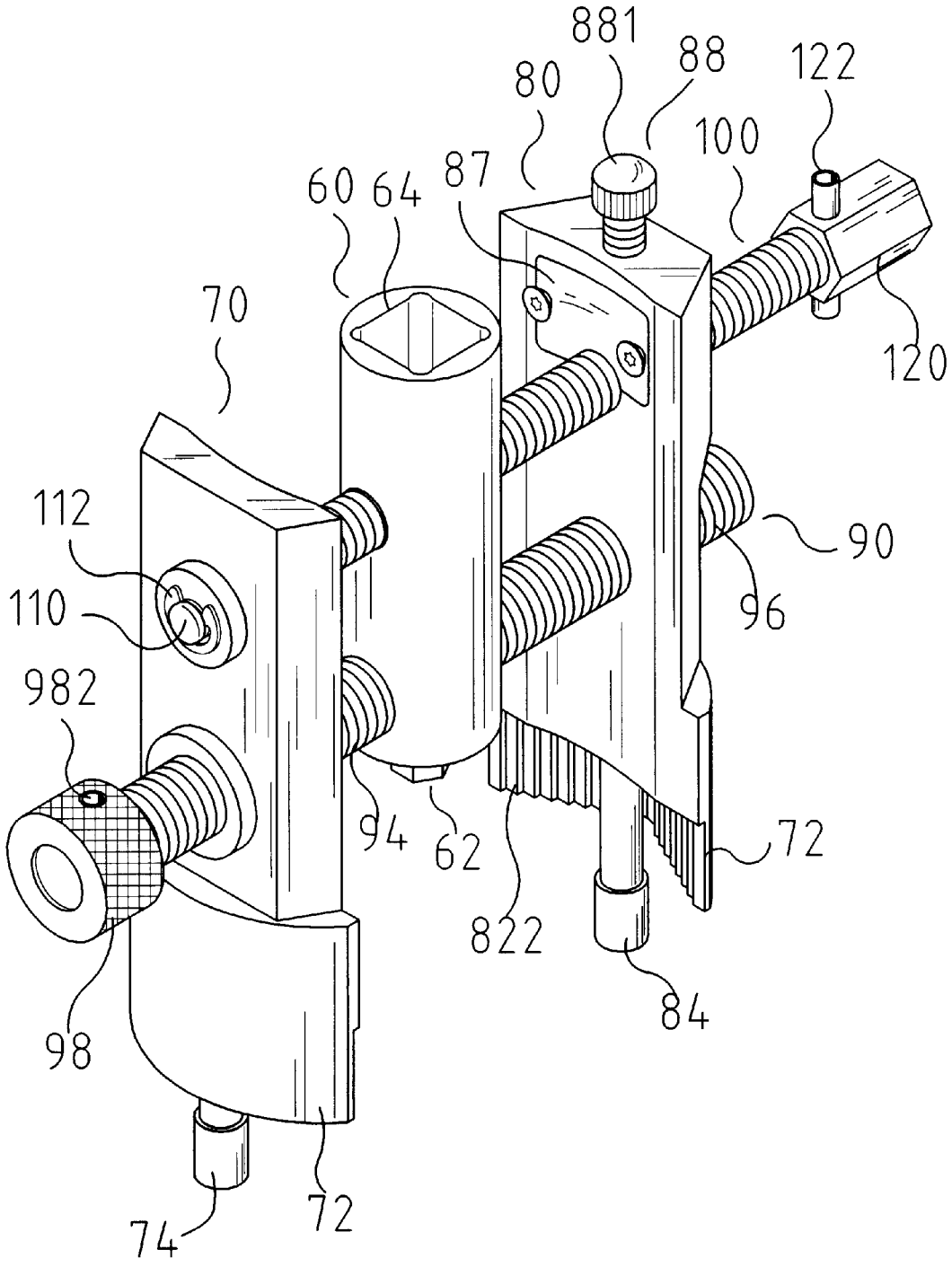
FIG. 10 is a perspective view of a combination tool for assembling and dismantling a lock nut of a bearing of a wheel axle of a wheeled vehicle in accordance with a second embodiment of the present invention.
Figure 11:
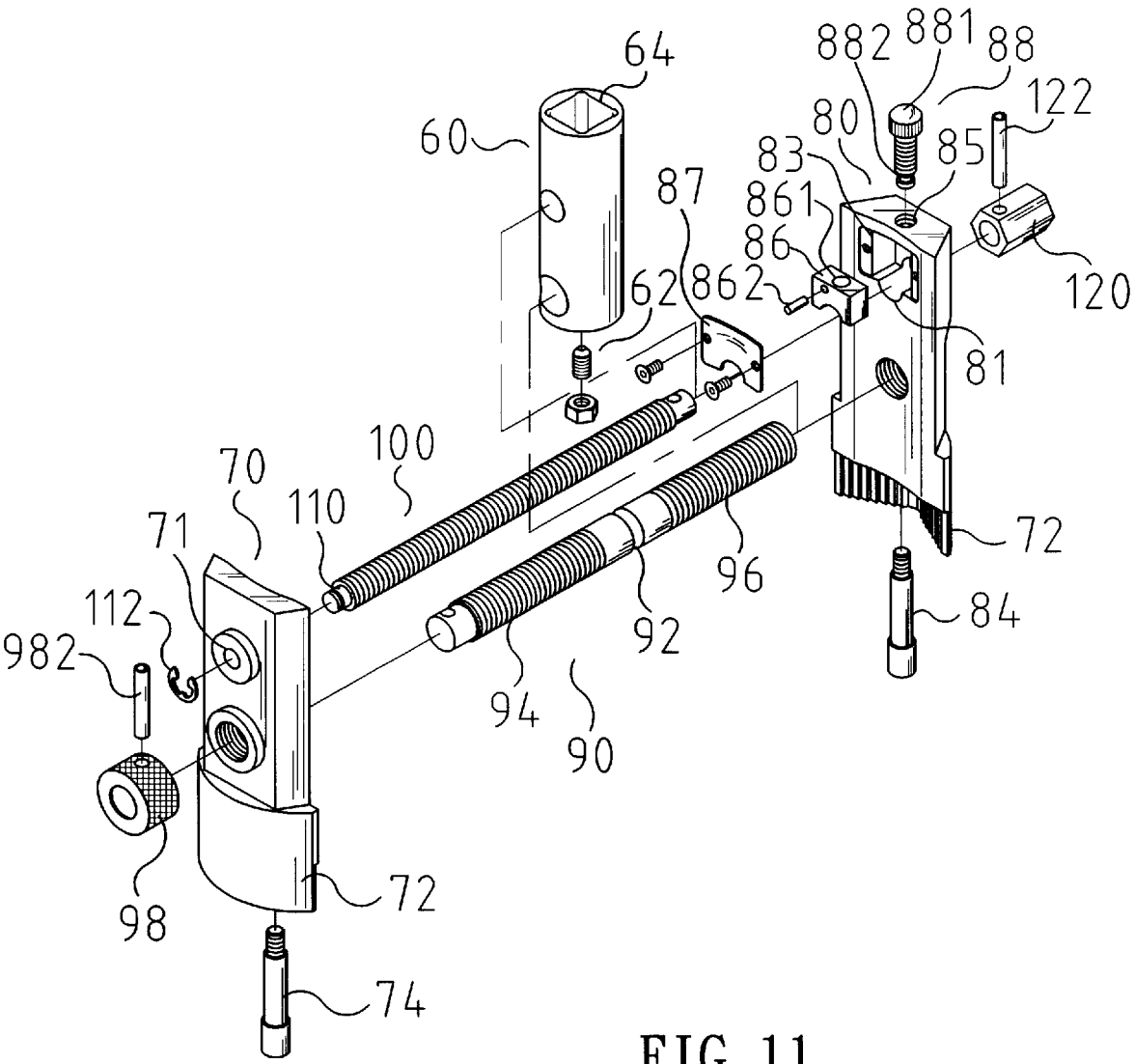
FIG. 11 is an exploded perspective view of a combination tool for assembling and dismantling a lock nut of a bearing of a wheel axle of a wheeled vehicle in accordance with a second embodiment of the present invention.
Figure 12:
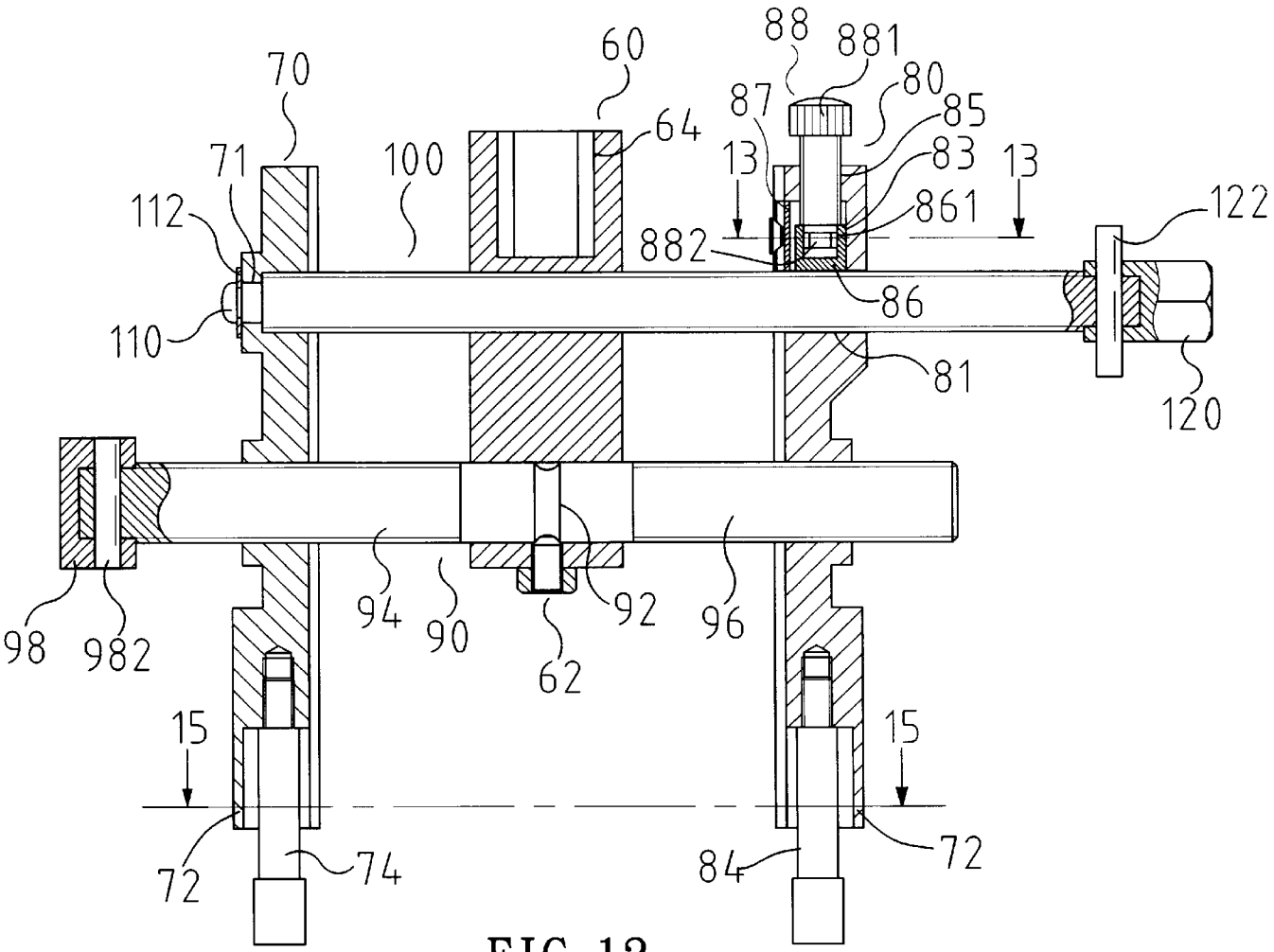
FIG. 12 is a front plan cross-sectional view of the combination tool for assembling and dismantling a lock nut of a bearing of a wheel axle of a wheeled vehicle as shown in FIG. 10.

Referring to FIGS. 10–12, a combination tool for assembling and dismantling a lock nut of a bearing of a wheel axle of a wheeled vehicle in accordance with a second embodiment of the present invention comprises a middle column 60, a first clamp block 70, a second clamp block 80, a regulating threaded rod 90, and a support rod 100.

The middle column 60 has a first end having an end face having an axial center defining a polygonal recess 64.

The first clamp block 70 and the second clamp block 80 are located at the two sides of the middle column 60 respectively, and the distance between the first clamp block 70 and the middle column 60 is equal to that between the second clamp block 80 and the middle column 60. Namely, the middle column 60 is located at the middle position between the first clamp block 70 and the second clamp block 80.

The regulating threaded rod 90 is radially extended through the middle column 60, so that the middle column 60 is positioned at the middle section of the regulating threaded rod 90. The middle section of the regulating threaded rod 90 is formed with an annular insertion groove 92. A positioning bolt 62 is screwed into a second end of the middle column 60 and has a distal end inserted into the insertion groove 92 of the regulating threaded rod 90, such that the middle column 60 is positioned at the middle section of the regulating threaded rod 90.

The regulating threaded rod 90 has a first end provided with a first threaded section 94 and a second end provided with a second threaded section 96 that has a screw direction opposite to that of the first threaded section 94. The first threaded section 94 and the second threaded section 96 are extended through the first clamp block 70 and the second clamp block 80 respectively. Thus, when the regulating threaded rod 90 is rotated, the first clamp block 70 and the second clamp block 80 are driven to move toward each other or to move outward relative to each other on the regulating threaded rod 90, such that the distance between the first clamp block 70 and the second clamp block 80 can be adjusted. An end cap 98 is secured on one end of the regulating threaded rod 90, and an insertion pin 982 is radially extended through the end cap 98 and the regulating threaded rod 90, thereby facilitating rotation of the regulating threaded rod 90.

The first clamp block 70 is formed with a shaft hole 71, and the second clamp block 80 is formed with a shaft hole 81. The support rod 100 has a first end provided with a pivot shaft 110 which is extended through the shaft hole 71 of the first clamp block 70 and is retained by a C-shaped snap ring 112. The support rod 100 has a second end extended through the shaft hole 81 of the second clamp block 80. A polygonal end cap 120 is secured on the second end of the support rod 100 by an insertion pin 122, so that a driver, such as a wrench, may drive the end cap 120 to rotate the support rod 100. Thus, the support rod 100 is in turn extended through the second clamp block 80, the middle column 60, and the first clamp block 70, to support and position the middle column 60, the first clamp block 70, and the second clamp block 80, so that the first clamp block 70 and the second clamp block 80 cannot be rotated relative to each other.

The second clamp block 80 is formed with a receiving chamber 83 communicating with the shaft hole 81. The second clamp block 80 has a top formed with a screw bore 85 communicating with the receiving chamber 83.

A gate-shaped member 86 is movably mounted in the receiving chamber 83 of the second clamp block 80, and is retained by a sealing plate 87. The gate-shaped member 86 has a top formed with a pivot hole 861. A bolt 88 is screwed into the screw bore 85 of the second clamp block 80, and has a top formed with an enlarged head 881, and has a bottom formed with a reduced neck 882 received in the pivot hole 861 of the gate-shaped member 86.

Figure 13:
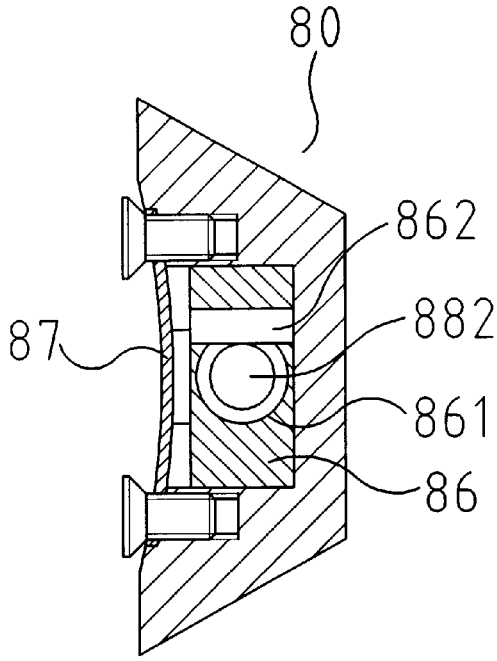
FIG. 13 is a cross-sectional view of the combination tool for assembling and dismantling a lock nut of a bearing of a wheel axle of a wheeled vehicle taken along line 13—13 as shown in FIG. 12.

A pin 862 is inserted into the gate-shaped member 86, and is rested on the reduced neck 882 of the bolt 88 as shown in FIG. 13, so that the bolt 88 is pivotally connected with the gate-shaped member 86. Thus, the gate-shaped member 86 may be lifted or lowered by rotation of the bolt 88.

Figure 14:
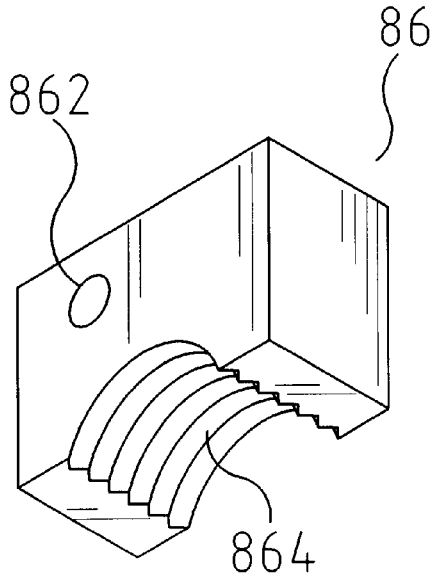
FIG. 14 is a perspective view of a gate-shaped member of the combination tool for assembling and dismantling a lock nut of a bearing of a wheel axle of a wheeled vehicle in accordance with the second embodiment of the present invention.

As shown in FIG. 14, the gate-shaped member 86 has a bottom formed with a threaded portion 864 that may mesh with the support rod 100. Thus, when the gate-shaped member 86 is lowered by rotation of the bolt 88, the threaded portion 864 of the gate-shaped member 86 may mesh with the support rod 100. Thus, when the support rod 100 is rotated, the second clamp block 80 may be slightly moved relative to the first clamp block 70, so that the first clamp block 70 and the second clamp block 80 may be parallel with the middle column 60.

In addition, the first end of the middle column 60 adjacent to the support rod 100 is protruded outward from the region enclosed by the first clamp block 70 and the second clamp block 80. Thus, the driver head 152 (see FIG. 9) of a hand tool such as a ratchet wrench 150 (see FIG. 9) or the like may be inserted into the polygonal recess 64 of the middle column 60, to rotate the middle column 60, so as to drive the first clamp block 70 and the second clamp block 80 to rotate.

Figure 15:
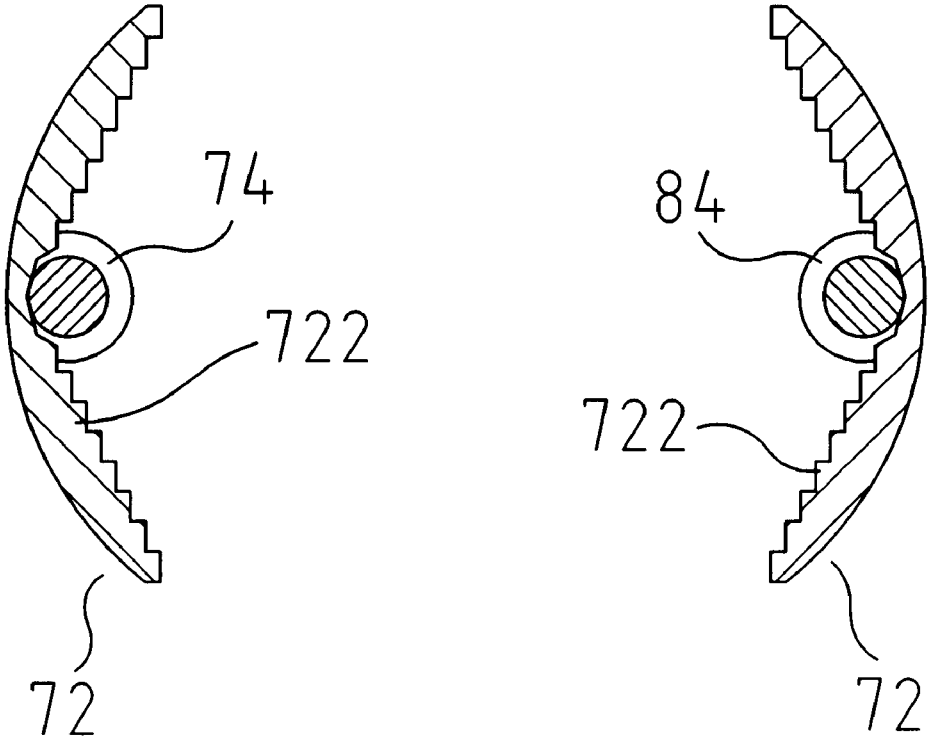
FIG. 15 is a cross-sectional view of the combination tool for assembling and dismantling a lock nut of a bearing of a wheel axle of a wheeled vehicle taken along line 15—15 as shown in FIG. 12.

Referring to FIGS. 11 and 15, each of the first clamp block 70 and the second clamp block 80 has one end respectively provided with a clamp pawl 72. The clamp pawl 72 has an inner edge having two opposite sides each formed with multiple ratchet teeth 722 for enhancing the holding effect of the clamp pawl 72. Each of the ratchet teeth 722 has a first side parallel with the axial direction of the regulating threaded rod 90, and a second side vertical to the axial direction of the regulating threaded rod 90.

Each of the first clamp block 70 and the second clamp block 80 has a distal end having a central portion respectively screwed with a pin 74 and 84 that may be inserted into two opposite holes 2 of a disk-shaped lock nut (see FIG. 1), for assembling and dismantling the disk-shaped lock nut as shown in FIG. 8.

In operation, referring to FIGS. 10–14, the gate-shaped member 86 may be lifted by rotation of the bolt 88 as shown in FIGS. 11–14, thereby detaching the threaded portion 864 of the gate-shaped member 86 from the support rod 100. Thus, the regulating threaded rod 90 may be rotated, so as to adjust the distance between the first clamp block 70 and the second clamp block 80. At the same time, the middle column 60, the first clamp block 70 and the second clamp block 80 are limited by the support rod 100, so that they cannot be rotated with the regulating threaded rod 90. In such a manner, the second clamp block 80 may be moved on the support rod 100 freely, so that is it not necessary to rotate the support rod 100 to facilitate adjustment of the distance between the first clamp block 70 and the second clamp block 80, thereby facilitating the user adjusting the distance between the first clamp block 70 and the second clamp block 80.

Alternatively, the gate-shaped member 86 may be lowered by rotation of the bolt 88 as shown in FIGS. 11–14, the threaded portion 864 of the gate-shaped member 86 may mesh with the support rod 100. Thus, when the support rod 100 is rotated, the second clamp block 80 may be slightly moved relative to the first clamp block 70, so that the first clamp block 70 and the second clamp block 80 may be calibrated to be parallel with the middle column 60, so that the clamp pawls 72 may clamp the lock nut rigidly and stably.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A combination tool for assembling and dismantling a lock nut of a bearing of a wheel axle of a wheeled vehicle, comprising a middle column, a first clamp block, a second clamp block, a regulating threaded rod, and a support rod, wherein:

the middle column has a first end having an end face having an axial center defining a polygonal recess;

the first clamp block and the second clamp block are located at two sides of the middle column, and a distance between the first clamp block and the middle column is equal to that between the second clamp block and the middle column, each of the first clamp block and the second clamp block has one end respectively provided with a clamp pawl;

each of the first clamp block and the second clamp block has a distal end having a central portion respectively provided with a pin for assembling and dismantling a disk-shaped lock nut;

the regulating threaded rod is radially extended through the middle column, so that the middle column is positioned at a middle section of the regulating threaded rod, the regulating threaded rod has a first end provided with a first threaded section and a second end provided with a second threaded section having a screw direction opposite to that of the first threaded section, the first threaded section and the second threaded section are respectively extended through the first clamp block and the second clamp block, so that a distance between the first clamp block and the second clamp block can be adjusted; and the support rod is in turn extended through the second clamp block, the middle column and the first clamp block, to support and position the middle column, the first clamp block, and the second clamp block.

2. The combination tool for assembling and dismantling a lock nut of a bearing of a wheel axle of a wheeled vehicle in accordance with claim 1, wherein the middle section of the regulating threaded rod is formed with an annular insertion groove, and the combination tool further comprises a positioning bolt mounted on the middle column and received in the insertion groove of the regulating threaded rod, such that the middle column is positioned at the middle section of the regulating threaded rod.

3. The combination tool for assembling and dismantling a lock nut of a bearing of a wheel axle of a wheeled vehicle in accordance with claim 2, wherein the positioning bolt is radially extended through the middle column.

4. The combination tool for assembling and dismantling a lock nut of a bearing of a wheel axle of a wheeled vehicle in accordance with claim 2, wherein the positioning bolt is screwed on a second end of the middle column.

5. The combination tool for assembling and dismantling a lock nut of a bearing of a wheel axle of a wheeled vehicle in accordance with claim 1, further comprising an end cap secured on one end of the regulating threaded rod, and an insertion pin radially extended through the end cap and the regulating threaded rod, thereby facilitating rotation of the regulating threaded rod.

6. The combination tool for assembling and dismantling a lock nut of a bearing of a wheel axle of a wheeled vehicle in accordance with claim 1, wherein the first clamp block has an inner wall defining an insertion cavity, and the support rod is in turn extended through the second clamp block and the middle column, and has a distal end pivotally inserted into the insertion cavity of the first clamp block, to support and position the middle column, the first clamp block, and the second clamp block.

7. The combination tool for assembling and dismantling a lock nut of a bearing of a wheel axle of a wheeled vehicle in accordance with claim 6, wherein the support rod is extended through a nut that is secured on an outer wall of the second clamp block.

8. The combination tool for assembling and dismantling a lock nut of a bearing of a wheel axle of a wheeled vehicle in accordance with claim 1, wherein the support rod has a first end pivotally connected with the first clamp block, and a second end radially extended through the middle column and the second clamp block, to support and position the middle column, the first clamp block, and the second clamp block.

9. The combination tool for assembling and dismantling a lock nut of a bearing of a wheel axle of a wheeled vehicle in accordance with claim 8, wherein the first end of the support rod is provided with a pivot shaft which is extended through the first clamp block and is retained by a C-shaped snap ring.

10. The combination tool for assembling and dismantling a lock nut of a bearing of a wheel axle of a wheeled vehicle in accordance with claim 8, wherein the second end of the support rod is extended through the second clamp block, and a polygonal end cap is secured on the second end of the support rod.

11. The combination tool for assembling and dismantling a lock nut of a bearing of a wheel axle of a wheeled vehicle in accordance with claim 10, wherein the polygonal end cap is secured on the second end of the support rod by an insertion pin.

12. The combination tool for assembling and dismantling a lock nut of a bearing of a wheel axle of a wheeled vehicle in accordance with claim 1, wherein the second clamp block is formed with a receiving chamber, and has a top formed with a screw bore communicating with the receiving chamber, a gate-shaped member is movably mounted in the receiving chamber of the second clamp block, the gate-shaped member has a bottom formed with a threaded portion that may mesh with the support rod, a bolt is screwed into the screw bore of the second clamp block, the bolt has a bottom pivotally connected with the gate-shaped member, so that the gate-shaped member may be lifted and lowered by rotation of the bolt.

13. The combination tool for assembling and dismantling a lock nut of a bearing of a wheel axle of a wheeled vehicle in accordance with claim 12, wherein the gate-shaped member is retained by a sealing plate.

14. The combination tool for assembling and dismantling a lock nut of a bearing of a wheel axle of a wheeled vehicle in accordance with claim 12, wherein the bolt has a top formed with an enlarged head.

15. The combination tool for assembling and dismantling a lock nut of a bearing of a wheel axle of a wheeled vehicle in accordance with claim 12, wherein the gate-shaped member has a top formed with a pivot hole, the bolt has a bottom formed with a reduced neck received in the pivot hole of the gate-shaped member, and a pin is inserted into the gate-shaped member, and is rested on the reduced neck of the bolt, so that the bolt is pivotally connected with the gate-shaped member.

16. The combination tool for assembling and dismantling a lock nut of a bearing of a wheel axle of a wheeled vehicle in accordance with claim 1, wherein the clamp pawl has an inner edge having two sides each formed with a first clamp face and a second clamp face, the first clamp face is adjacent to a central shaft of the inner edge of the clamp pawl, the first clamp faces of the two sides of the inner edge of the clamp pawl are symmetrical with each other, and have an included angle equal to 120 degrees, for clamping an outer periphery of a hexagonal lock nut, and the second clamp faces of the two sides of the inner edge of the clamp pawl are symmetrical with each other, and have an included angle equal to 135 degrees, for clamping an outer periphery of a octagonal lock nut.

17. The combination tool for assembling and dismantling a lock nut of a bearing of a wheel axle of a wheeled vehicle in accordance with claim 1, wherein the clamp pawl has an inner edge having two opposite sides each formed with multiple ratchet teeth for enhancing the holding effect of the clamp pawl.

18. The combination tool for assembling and dismantling a lock nut of a bearing of a wheel axle of a wheeled vehicle in accordance with claim 17, wherein each of the ratchet teeth has a first side parallel with the axial direction of the regulating threaded rod, and a second side vertical to the axial direction of the regulating threaded rod.

19. The combination tool for assembling and dismantling a lock nut of a bearing of a wheel axle of a wheeled vehicle in accordance with claim 1, wherein the first end of the middle column is protruded outward from a region enclosed by the first clamp block and the second clamp block.

* * * * *